US008528378B2

(12) United States Patent
Hayashi

(10) Patent No.: US 8,528,378 B2
(45) Date of Patent: Sep. 10, 2013

(54) METHOD FOR PRODUCING ULTRATHIN-WALL SEAMLESS METAL TUBE BY COLD ROLLING METHOD

(75) Inventor: Chihiro Hayashi, Sendai (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/246,086

(22) Filed: Sep. 27, 2011

(65) Prior Publication Data

US 2012/0036911 A1 Feb. 16, 2012

Related U.S. Application Data

(63) Continuation of application No. PCT/JP2010/054943, filed on Mar. 23, 2010.

(30) Foreign Application Priority Data

Apr. 3, 2009 (JP) ..... 2009-090890

(51) Int. Cl.
*B21B 17/10* (2006.01)

(52) U.S. Cl.
USPC ..... 72/208; 72/209; 72/214; 72/252

(58) Field of Classification Search
USPC ..... 72/96, 97, 197, 208, 209, 214, 220, 72/252.5, 365.2, 370, 370.14, 370.25, 189, 72/193
See application file for complete search history.

(56) References Cited

U.S. PATENT DOCUMENTS 3,670,549 A * 6/1972 Tselikov et al. ..... 72/208
3,862,560 A * 1/1975 Grinshpun et al. ..... 72/252
3,890,821 A * 6/1975 Gerretz et al. ..... 72/208
3,948,070 A * 4/1976 Hentzschel et al. ..... 72/10.3
4,184,352 A * 1/1980 Potapov et al. ..... 72/208
4,655,068 A * 4/1987 Schemel ..... 72/208
4,730,473 A * 3/1988 Rottlander et al. ..... 72/12.7

FOREIGN PATENT DOCUMENTS

| | | | |
|---|---|---|---|
| CN | 101184561 | | 5/2008 |
| DE | 2924835 | * | 6/1979 |
| EP | 1 884 296 | | 2/2008 |
| GB | 2 093 384 | | 9/1982 |

(Continued)

OTHER PUBLICATIONS

DE 2924835 translation.*

(Continued)

*Primary Examiner* — Dana Ross
*Assistant Examiner* — Homer Boyer
(74) *Attorney, Agent, or Firm* — Clark & Brody

(57) ABSTRACT

A method for producing an ultrathin-wall seamless metal tube, which employs a cold pilger mill of mechatronics drive type including a mechanism to give a feed and a turn angle to a tube material, utilizes a roll having a tapered groove whose diameter gradually increases or gradually decreases from an engaging entry side to a finishing exit side of a pair of rolls, and a tapered mandrel whose diameter similarly gradually increases from the engaging entry side to the finishing exit side to elongate the tube material by reducing a wall thickness while expanding a mid-wall diameter of the tube material. By giving amounts of a turn angle and/or a feed equivalent or nearly equivalent to the forward stroke to the tube material immediately before the start of a backward stroke, it is possible to achieve a further increase in the reduction-rate of rolling, a further reduction of wall thickness, and improvement of dimensional accuracy of the product.

5 Claims, 6 Drawing Sheets

(56) References Cited

FOREIGN PATENT DOCUMENTS

| | | |
|---|---|---|
| JP | 59-76603 | 5/1984 |
| JP | 59-159204 | 9/1984 |
| JP | 2006-326651 | 12/2006 |
| WO | 2009/072194 | 6/2009 |

OTHER PUBLICATIONS

"Iron and Steel Handbook third edition", vol. 3 (2), Steel Bar, Steel Tube, and Common Rolling Facilities, pp. 1183-1189, 1980.

* cited by examiner

FIG. 7A
FIG. 7B
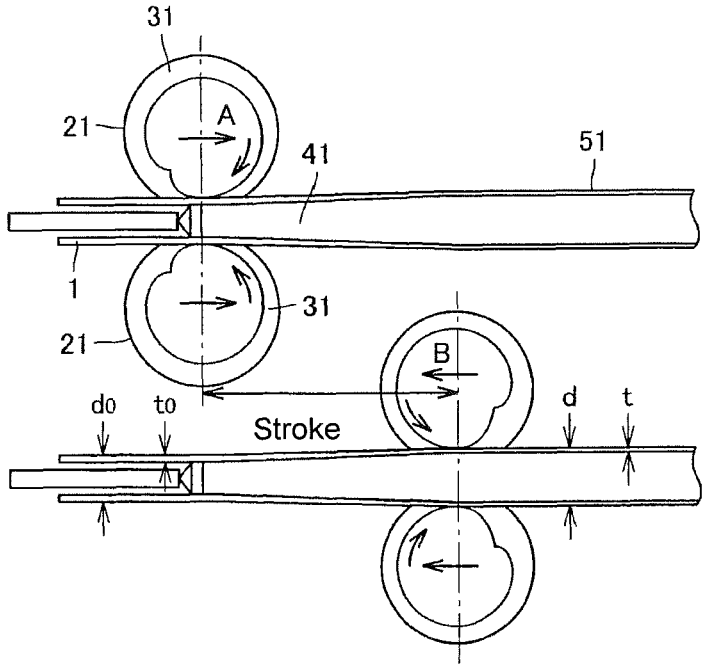
FIG. 8A
FIG. 8B
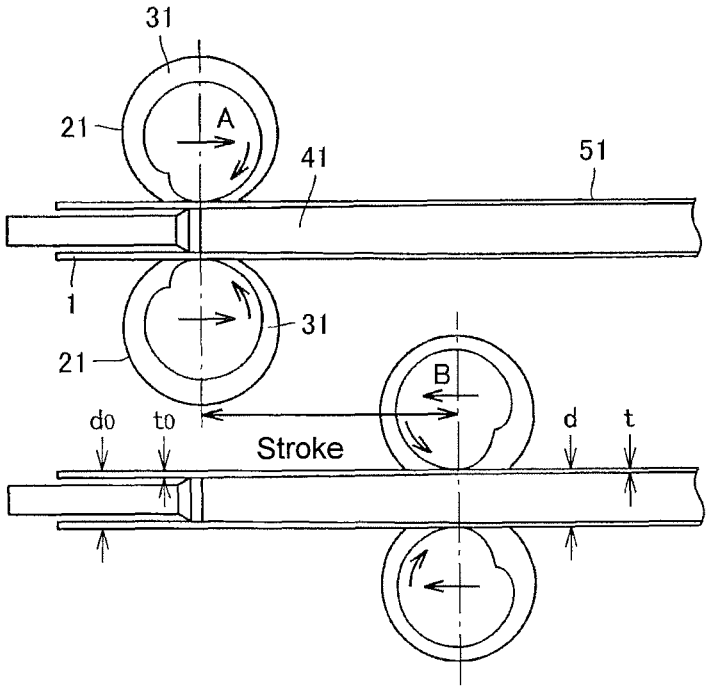

METHOD FOR PRODUCING ULTRATHIN-WALL SEAMLESS METAL TUBE BY COLD ROLLING METHOD

TECHNICAL FIELD

The present invention intends to provide a method for producing an ultrathin-wall seamless metal tube by a high-reduction-rate, highly efficient rolling method utilizing a cold pilger mill of a mechatronics drive type developed in 1985.

BACKGROUND ART

When a metal tube does not satisfy any requirement in quality, strength, or dimensional accuracy in a hot finished condition, the metal tube needs to be subjected to a cold working process. Such cold working is generally performed by a cold drawing method using a die and a plug or mandrel, or a cold rolling method by a cold pilger mill.

In a conventional cold rolling method by a cold pilger mill, a hollow shell is subjected to a diameter reducing rolling between a pair of rolls having a tapered groove whose diameter gradually decreases in a circumferential direction, and a tapered mandrel whose diameter gradually decreases similarly in a longitudinal direction. That is, each roll of the pair is provided with a groove on its circumference and the groove is shaped such that its width is narrowed as the rolling occur. The rolls repeatedly move forward and backward while rotating along the taper of the mandrel, thereby rolling the hollow shell between the roll and the mandrel (such as Non Patent Literature 1).

FIG. 1 is a diagram to show a rolling mechanism by a conventional cold pilger mill, in which FIG. 1A illustrates a starting point of forward stroke, and FIG. 1B illustrates a starting point of backward stroke. A roll housing having a pair of grooved rolls 2 makes a reciprocating movement via a connecting rod of a crank mechanism. At that moment, pinions which are integrated with the rolls 2 engage with racks so that the rolls 2 are caused to rotate in association with the reciprocating movement.

The cold pilger mill includes a pair of grooved rolls 2 and a mandrel 4. The grooved roll 2 has in its outer circumference a groove whose diameter smoothly varies from an outer diameter (d0 in the diagram) of the hollow shell 1 to the outer diameter (d in the diagram) of a finished rolled tube 5 as being from the engaging entry side toward the finishing exit side of the roll. Further, the mandrel 4 also has a tapered shape whose diameter smoothly varies in a similar fashion. Thus, the roll housing having the above described rolls 2 makes a reciprocating movement thereby rolling the tube material (hollow shell) 1.

The tube material 1 is given a predetermined amount of travel (feed) and rotation (turn) angle immediately before the start of a forward stroke. In a normal rolling, the feed is about 5 to 18 mm and the turn angle is about 60°. In this arrangement, the tube material is subjected to a diameter reducing rolling in both the forward and backward strokes. It was not, however, possible until about 25 years ago to give a feed and a turn angle to the tube material in the backward stroke, and only a re-rolling is performed to remove an elastic restitution in the elongation rolling of forward stroke.

Meanwhile, in around 1985, a drastic simplification of the overall structure of the cold pilger mill was achieved by replacing its mechanical interlocking mechanism with a mechatronics system. That is, the structure of the facility is simplified and its size is reduced by replacing the mechanical intermittent motion with an electric driving mechanism. Particularly, adopting electric control and hydraulic servo control has eliminated complex works such as the replacement of cams and allowed the setting of the feed amount and turn angle of the tube material to be performed simply and precisely in a stepless manner so that the setting and change of the turn angle and feed can be performed with the simple touch of a button.

In this way, there was produced a surplus in the driving energy that had been primarily consumed for the purpose of the transmission of power, which makes it possible to give certain amounts of feed and turn angle even immediately before the start of a backward stroke, however, it turned out that when a little feed is given, yet an excessive rolling load is generated, while not so much in giving a turn angle, resulting in the overloading of the facility, thereby disabling the rolling. Of course, an imbalance in the load between both forward and backward strokes would become pronounced.

CITATION LIST

Patent Literature

Patent Literature 1: PCT/JP2007/073468

Non Patent Literature

Non Patent Literature 1: "Iron and Steel Handbook third edition," Vol. 3, (2) Steel Bar, Steel Tube, and Common Rolling Facilities, pp. 1183 to 1189.

SUMMARY OF INVENTION

Technical Problem

The present invention has been made in view of the above described problems, and has its object to provide a method for producing an ultrathin-wall seamless metal tube by a high-reduction-rate, highly efficient diameter expanding rolling method utilizing a cold pilger mill. More specifically, its object is to provide a method for producing an ultrathin-wall seamless metal tube by a cold rolling method by which equivalent amounts of turn angle and feed can be given not only immediately before the start of a forward stroke, but also immediately before the start of a backward stroke in a cold pilger mill that performs elongation rolling in both the forward and backward strokes.

Solution to Problem

The present inventors have previously invented a method for producing an ultrathin-wall metal tube, wherein in a rolling method by a cold pilger mill of mechanical drive type adapted for performing elongation rolling in both the forward and backward strokes in a single strand, a diameter expanding rolling is performed in both the forward and backward strokes using a roll having a groove whose diameter gradually increases from the engaging entry side to the finishing exit side, and a mandrel whose diameter also gradually increases from the engaging entry side to the finishing exit side; and proposed it as Patent Literature 1 as described above.

According to the invention disclosed in Patent Literature 1 (hereafter also referred to as the "previous invention"), although a dramatically high reduction-rate is obtained and the production of an ultrathin-wall metal tube becomes possible, the invention is solely drawn to a conventional rolling method in which a feed and a turn angle are given mainly only immediately before the start of a forward stroke. Of course, since adopting a diameter expanding rolling method reduces the energy consumption needed for elongation rolling, a surplus in driving energy is generated thereby enabling certain amounts of turn angle and feed to be given even in the backward stroke.

FIG. 2 is a diagram to show a rolling method by a cold pilger mill of mechanical drive type relating to the previous invention, in which FIG. 2A illustrates a starting point of a forward stroke, and FIG. 2B illustrates a starting point of a backward stroke. As shown in FIG. 2A in the same diagram, a pair of upper and lower rolls 21 each of which is provided in its circumference with a tapered groove 31 whose diameter smoothly increases from an engaging entry side toward a finishing exit side moves forward along arrow A shown in the diagram along the taper of a tapered mandrel 41 whose outer diameter smoothly increases from the engaging entry side toward the finishing exit side, so that a hollow shell 1 is subjected to elongation rolling between the surface of the tapered groove 31 of the roll 21 and the surface of the tapered mandrel 41.

Next, as shown by B in the same diagram, while the pair of upper and lower rolls 21 reverses its rotation direction thereby moving backward in the direction shown by arrow B in the diagram, the hollow shell 1 is subjected to elongation rolling between the tapered groove 31 of the roll 21 and the tapered mandrel 41 in the same fashion.

Repeating the forward and backward rolling strokes as described above will result in that the hollow shell 1 having an outer diameter d0 and a wall thickness t0undergoes diameter expanding rolling to be formed into a rolled tube product 51 having an outer diameter d and a wall thickness t.

In order to solve the above described problems, the inventors have conducted the research and development of a cold rolling method, wherein in a cold pilger mill for performing elongation rolling in both the forward and backward strokes, equivalent amounts of turn angle and feed to those in the forward stroke can be given not only immediately before the start of a forward stroke, but also immediately before the start of a backward stroke, and have eventually completed the invention.

In order to enable a cold rolling method by which equivalent amounts of turn angle and feed to those immediately before the start of a forward stroke can be given even immediately before the start of a backward stroke, it is necessary in particular to reduce the rolling load which will remarkably spike in the backward stroke and to achieve a balance in the rolling load between both the forward and backward strokes. These can be realized with the support of the following findings (a) to (d).

(a) First, a diameter expanding rolling method is adopted in place of the conventional diameter reducing rolling method. According to the diameter expanding rolling method, since a hollow shell having a smaller diameter is used compared with the case of a diameter reducing rolling to obtain the same product dimension, the rolling load in both the forward and backward strokes will remarkably decrease. This point is the same as in the case of the method for producing an ultrathin-wall metal tube according to the previous invention by the present inventors.

Here, the term "diameter expanding rolling" not only refers to a rolling method for simultaneously expanding the inner and outer diameters of a tube material, but also generally refers to the rolling method for expanding the mid-wall diameter (the average diameter of the inner and outer diameters) of a tube material.

Therefore, even if only the inner diameter is expanded with the outer diameter being kept constant and unchanged, that will result in a diameter expanding rolling since the mid-wall diameter will be surely expanded. Further, even if the outer diameter is reduced, when the amount of diameter expansion of the inner diameter is larger than the amount of diameter reduction of the outer diameter, the mid-wall diameter is expanded thereby resulting in a diameter expanding rolling.

(b) When a turn angle or a feed is given to a tube material at immediately before the start of a backward rolling stroke, the rolling load is likely to excessively increase, and a large imbalance in the rolling load between both the forward and backward strokes is likely to occur in the conventional diameter reducing rolling.

FIGS. 3 and 4 are conceptual diagrams to show the variations in the rolling load from the engaging entry side to the finishing exit side in both the forward and backward strokes in a diameter reducing rolling method and a diameter expanding rolling method. FIG. 3 shows the variation of rolling load in a diameter reducing rolling method, and FIG. 4 shows the variation of rolling load in a diameter expanding rolling method. In each of FIGS. 3A and 4A, shown is the case where a shell drive is not given immediately before the start of a backward rolling stroke, FIGS. 3B and 4B each being the case where an equivalent amount of turn angle to that of the forward stroke is given to the tube material immediately before the start of a backward rolling stroke, and FIG. 3C or 4C each being the case where equivalent amounts of turn angle and feed to those of the forward stroke are given immediately before the start of a backward rolling stroke.

The present inventors repeated theoretical and experimental investigations to clarify the above described phenomena, thus eventually obtaining the following findings. That is, it is concluded that the reason why as shown in FIGS. 3 and 4, the rolling load remarkably increases in the backward stroke compared with in the forward stroke when a shell drive is given to the tube material immediately before the starts of both forward and backward rolling strokes is that a backward force of tension in the forward stroke and a backward force of compression in the backward stroke are caused to act in an axial direction of the tube material between the entry side chuck (not shown) and the roll housing, and these forces are superimposed onto the rolling load.

That is, in the diameter reducing rolling method, although the decrease in the axial force of tension and resultant rolling load in the forward stroke is relatively small, the increase in the backward force of compression and the resultant rolling load in the axial direction in the backward stroke becomes very large, causing a large imbalance in the rolling load (see FIGS. 3B and 3C). In contrast to this, in the diameter expanding rolling method, although the decrease in the axial force of tension and the resultant rolling load in the forward stroke becomes somewhat remarkable, the increase in the axial force of compression and the resultant rolling load in the backward stroke becomes extremely small, and will not cause a large imbalance in the rolling load (see FIGS. 4B and 4C).

Therefore, when a turn angle and a feed are given to the tube material in both the forward and backward rolling strokes, it is seen that adopting a diameter expanding rolling method in place of a diameter reducing rolling method can help to stabilize the cold rolling. That is, when a turn and a feed are given to the tube material in both the forward and backward strokes, adoption of a diameter expanding rolling has a doubled effect in reducing the rolling load.

(c) When even if the diameter expanding rolling method is adopted, an imbalance in the rolling load between both the forward and backward rolling strokes remains. Thus, when this should cause operational problems, applying not so much diameter expansion rate is easier to ensure the balance. Since, in the diameter expanding rolling, the reduction of wall thickness starts concurrently with the beginning of engagement, the amount of diameter expansion may be much smaller compared with the amount of diameter reduction in the diameter reducing rolling. As the amount of diameter expansion becomes smaller, it becomes easier to ensure a balance in the rolling load between both the forward and backward strokes.

For example, as an extreme case, when the wall thickness is reduced by expanding only the inner diameter while keeping the outer diameter to be constant and unchanged in both the forward and backward rolling strokes, an only difference in the rolling condition between the forward and backward strokes will be the direction of rotation of the roll. In this connection, in the diameter reducing rolling as well, it becomes easier to ensure a balance in the rolling load between both the forward and backward rolling strokes, as the amount of diameter reduction becomes smaller.

(d) In the rolling method by a cold pilger mill in which the diameter expanding rolling is performed in both the forward and backward strokes, if a feed and a turn angle can be given not only immediately before the start of a forward stroke, but also immediately before the start of a backward stroke, it is possible to produce an ultrathin-wall tube at a diameter expansion rate (that is, (ratio of diameter expansion−1)×100 (%)) of about 10% even in the production of an ultrathin-wall seamless metal tube having a (wall thickness/outer diameter) ratio of not more than 4%. Moreover, even for the production of an ultrathin-wall seamless metal tube having a (wall thickness/outer diameter) ratio of not more than 2.5%, it is possible to produce an ultrathin-wall tube if a diameter expansion rate of about 20% can be ensured.

Here, a side effect of the diameter expanding rolling method will be described. This side effect does not exist in a conventional diameter reducing rolling. That is, in the case of diameter expanding rolling, attention needs to be paid to that an excessively large diameter expansion rate will make the feed of the tube material difficult. This is because a clearance cannot be ensured between the tube inner surface at flange regions of grooved rolls and the mandrel, whereby the feeding of the tube material becomes difficult. In this viewpoint as well, it is better not to adopt an excessively large diameter expansion rate.

Moreover, as long as a level of the diameter expansion rate as described above is applied, there is no need to specially devise the supporting method of the mandrel and tube material, and the shell drive system in the case of conventional diameter reducing rolling method can be utilized as-is.

The present invention has been completed based on the above described findings, and the gist of the invention consists in the method for producing an ultrathin-wall metal tube by a cold rolling method shown in the following (1) and (2).

(1) A method for producing an ultrathin-wall seamless metal tube by a cold rolling method, wherein the cold rolling method employs a cold pilger mill of mechatronics drive type, including: an electric control system to control a reciprocating movement of a roll stand and a shell drive of a tube material; and a mechanism to give a feed and a turn angle to the tube material immediately before the start of a forward stroke and immediately before the start of a backward stroke, and the cold rolling method includes: utilizing a roll having a groove whose diameter gradually increases, remains constant, or gradually decreases from an engaging entry side to a finishing exit side of a pair of rolls, and a tapered mandrel whose diameter gradually increases similarly from the engaging entry side to the finishing exit side; and giving a turn angle and a feed to the tube material immediately before the start of a forward stroke, and also giving a shell drive to the tube material immediately before the start of a backward stroke to an extent that is the same as or similar to the forward stroke so as to elongate the tube material by reducing a wall thickness while expanding a mid-wall diameter which is an average diameter of an outer diameter and an inner diameter of the tube material.

(2) In the method for producing an ultrathin-wall seamless metal tube by a cold rolling method, according to the above described (1), a system of giving a rotation angle (turn angle) to the tube material, a system of giving a feed to the tube material, or a system of giving a rotation angle (turn angle) and a feed to the tube material can be adopted as the shell drive immediately before the start of a backward stroke.

In the present invention, the term "roll stand" refers to a roll housing having a grooved roll 2.

Moreover, the term "shell drive" refers to an action to give a feed in a tube longitudinal direction or/and a rotation (turn) around the tube axis to the tube material (hollow shell) 1.

Further, as described above, the term "ultrathin-wall seamless metal tube" refers to a seamless metal tube having a (wall thickness/outer diameter) ratio of not more than 4%.

Advantageous Effects of Invention

The present invention is a diameter expanding rolling method using a cold pilger mill of mechatronics drive type including a mechanism to give a feed and a turn angle to the tube material not only immediately before the start of a forward stroke but also immediately before the start of a backward stroke, whereby a shell drive can be given to the tube material in a stable manner even immediately before the start of a backward stroke without generating an excessive rolling load and without resulting in an excessive imbalance in the rolling load between the forward stroke and the backward stroke. This makes it possible to realize a further increase in the reduction-rate of rolling and a further reduction of wall thickness, and significantly improve the dimensional accuracy and the production efficiency of the rolled tube product compared with the diameter expanding rolling method of the previous invention.

BRIEF DESCRIPTION OF DRAWINGS

FIG. 1 is a diagram to show a rolling mechanism by a conventional cold pilger mill, in which

FIG. 2 is a diagram to show a rolling method by a cold pilger mill of mechanical drive type relating to the previous invention, in which

FIG. 7 is a diagram to show a first aspect of the rolling method by a cold pilger mill relating to the present invention.

FIG. 8 is a diagram to show a second aspect of the rolling method by a cold pilger mill relating to the present invention.

DESCRIPTION OF EMBODIMENTS

The present invention is a method for producing an ultrathin-wall seamless metal tube by a cold rolling method, wherein the cold rolling method employs a cold pilger mill of mechatronics drive type, including an electric control system to control a reciprocating movement of a roll stand and a shell drive of a tube material, and a mechanism to give a feed and a turn angle to the tube material immediately before the start of a forward stroke and immediately before the start of a backward stroke, and the cold rolling method includes: utilizing a roll having a groove whose diameter gradually increases, remains constant, or gradually decreases from an engaging entry side to a finishing exit side of a pair of rolls, and a tapered mandrel whose diameter gradually increases similarly from the engaging entry side to the finishing exit side; and giving a turn angle and a feed to the tube material immediately before the start of a forward stroke, and also giving a turn angle or/and a feed to the tube material immediately before the start of a backward stroke so as to elongate the tube material by reducing a wall thickness while expanding a mid-wall diameter which is an average diameter of an outer diameter and an inner diameter of the tube material. As described before, however, the operation will be much further stabilized when a larger diameter expansion rate is not adopted.

Thus, by giving a shell drive (a turn angle or/and a feed to the tube material) even immediately before the start of a backward stroke in the above described method, it is made possible to realize a further increase in the reduction-rate of rolling and a further reduction of wall thickness, and significantly improve the dimensional accuracy and the production efficiency of the rolled tube product.

Hereafter, the method for producing an ultrathin-wall seamless metal tube of the present invention will be described on its drive system and further on various aspects of rolling, comparing with a cold rolling method by a conventional cold pilger mill of mechanical drive type in which the reciprocating movement of the roll stand and the shell drive of the tube material are controlled by a mechanical control system.

Figure 1A:
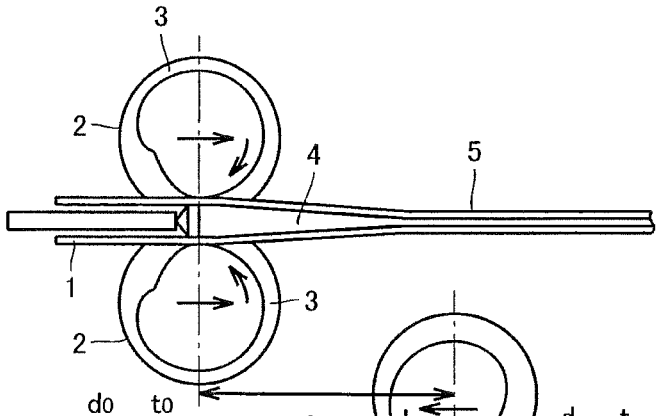
FIG. 1A illustrates a starting point of a forward stroke.
Figure 1B:
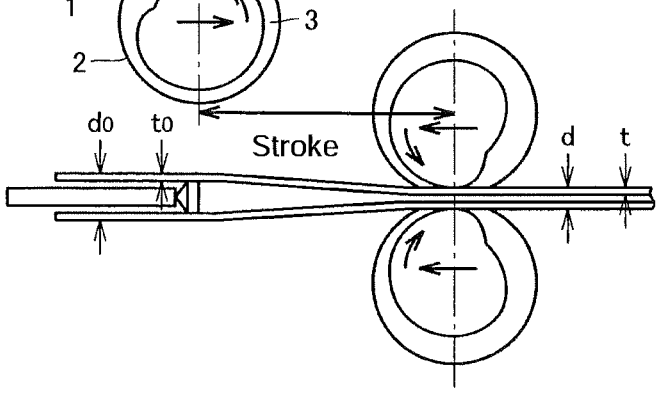
FIG. 1B illustrates a starting point of a backward stroke, respectively.
Figure 2A:
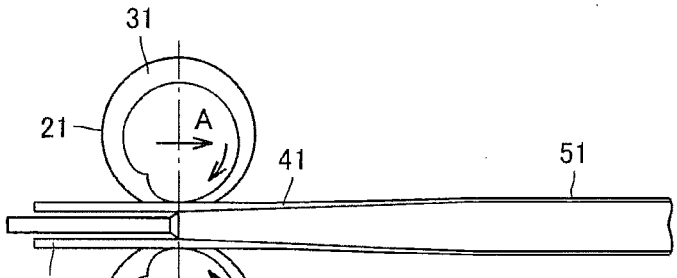
FIG. 2A illustrates a starting point of a forward stroke.
Figure 2B:
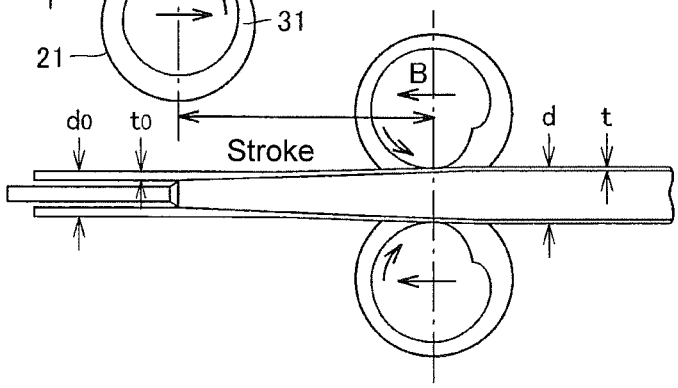
FIG. 2B illustrates a starting point of a backward stroke, respectively.
Figure 3A:
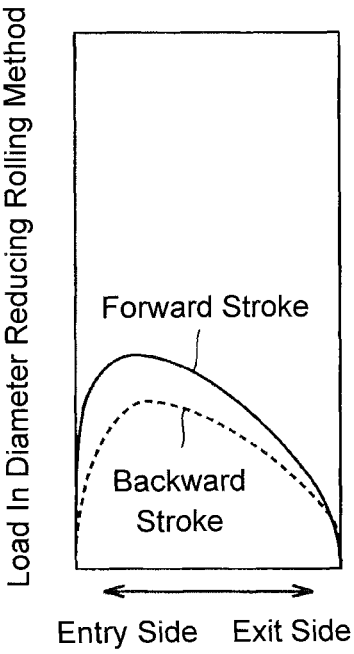
FIG. 3 is a conceptual diagram to show the variation of rolling load from an engaging entry side to a finishing exit side of both the forward and backward rolling strokes in a diameter reducing rolling method.
Figure 3B:
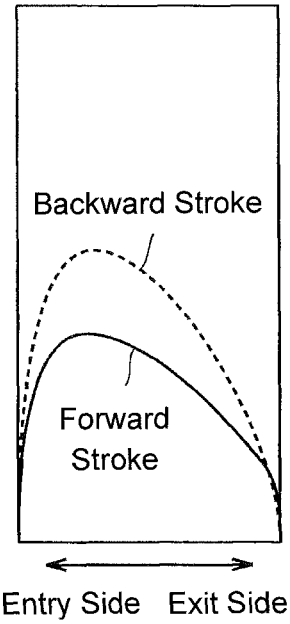
Figure 3C:
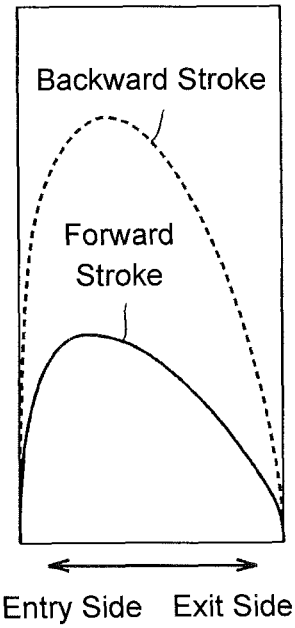
Figure 4A:
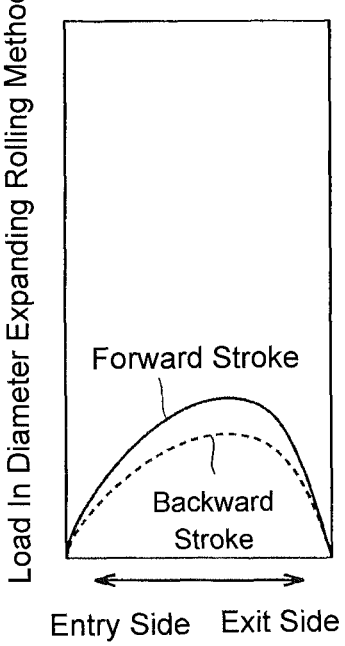
FIG. 4 is a conceptual diagram to show the variation of rolling load from an engaging entry side to a finishing exit side of both the forward and backward rolling strokes in a diameter expanding rolling method.
Figure 4B:
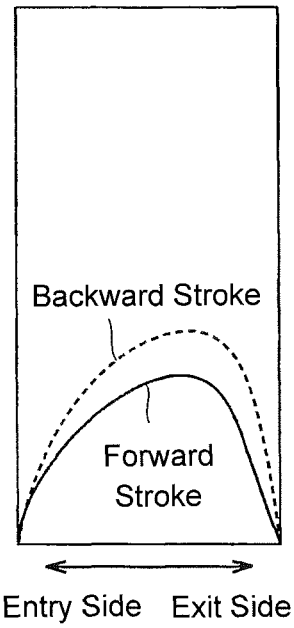
Figure 4C:
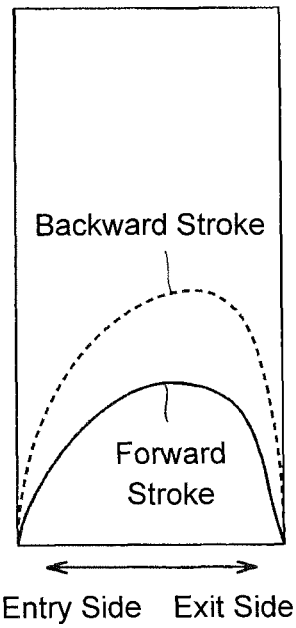
Figure 5:
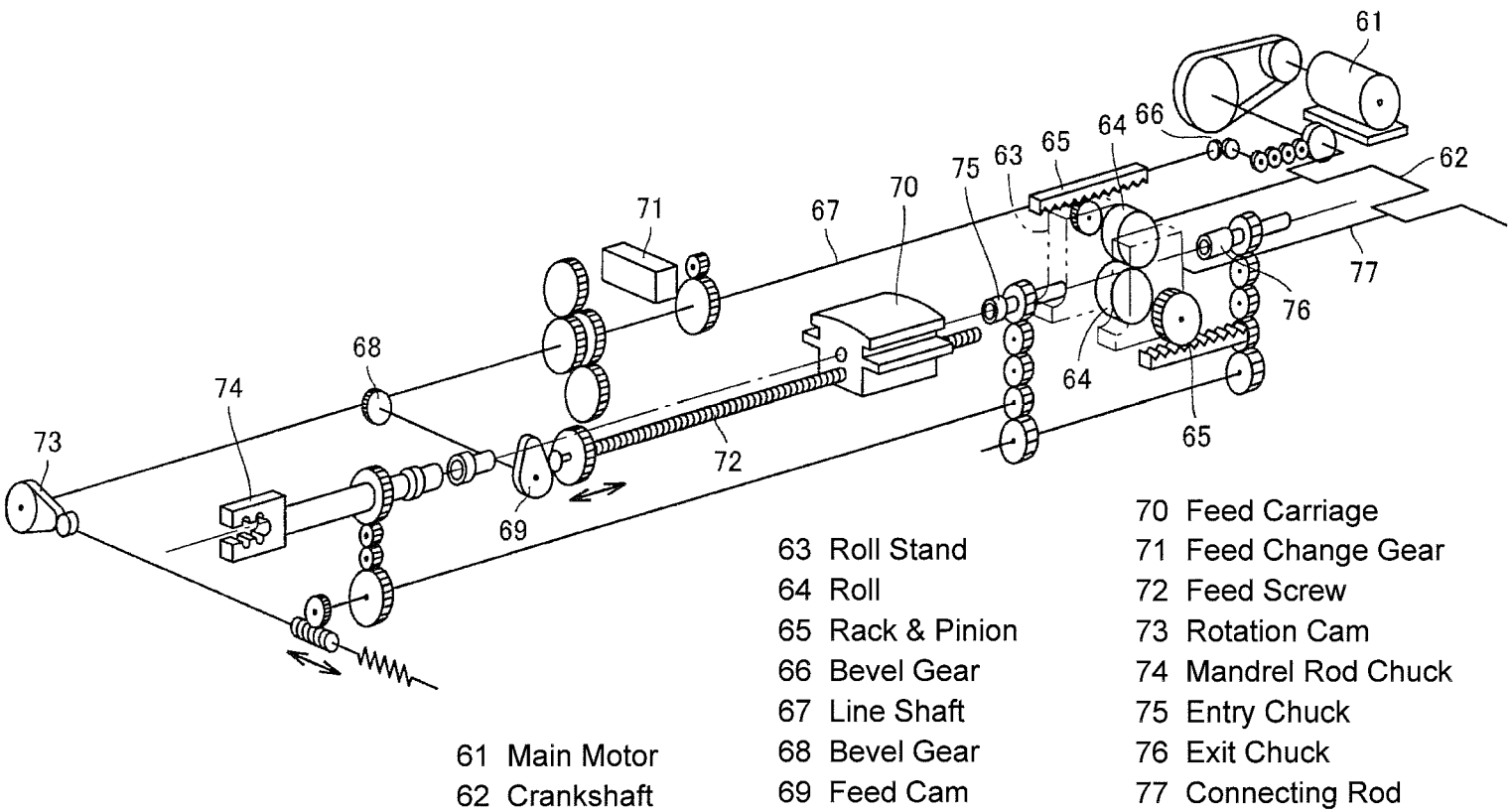
FIG. 5 is a diagram to show a schematic configuration of a cold pilger mill by a mechanical drive system.

FIG. 5 is a diagram to show a schematic configuration of a cold pilger mill by a mechanical drive system. A roll unit is contained in a roll stand 63 and connected to a crankshaft 62 via a connecting rod 77. The crankshaft 62 rotates by being driven by a main motor 61, and the roll stand 63 makes a reciprocating movement in a forward and backward direction at a constant frequency. A pair of upper and lower rolls 64 are rotated by racks and pinions 65 as the roll stand 63 moves forward and backward, thereby rolling a hollow shell (tube material).

A mandrel (not shown) is secured by a mandrel rod chuck 74. The hollow shell is held by an entry chuck 75 and an exit chuck 76, and a feed carriage 70 is located at the rear edge thereof. The rotation of the crankshaft 62 is transferred to a feed cam 69 and a rotation cam 73 via bevel gears 66 and 68 and a line shaft 67. The feed cam 69 causes the feed carriage 70 to move forward by the amount of lift of the cam at every time the roll stand 63 makes a round trip. On the other hand, the feed carriage 70 is caused to move forward at a constant speed so as to be intermittently traveled by a feed screw 72 that is rotated by the line shaft 67 via a feed change gear 71.

Figure 6:
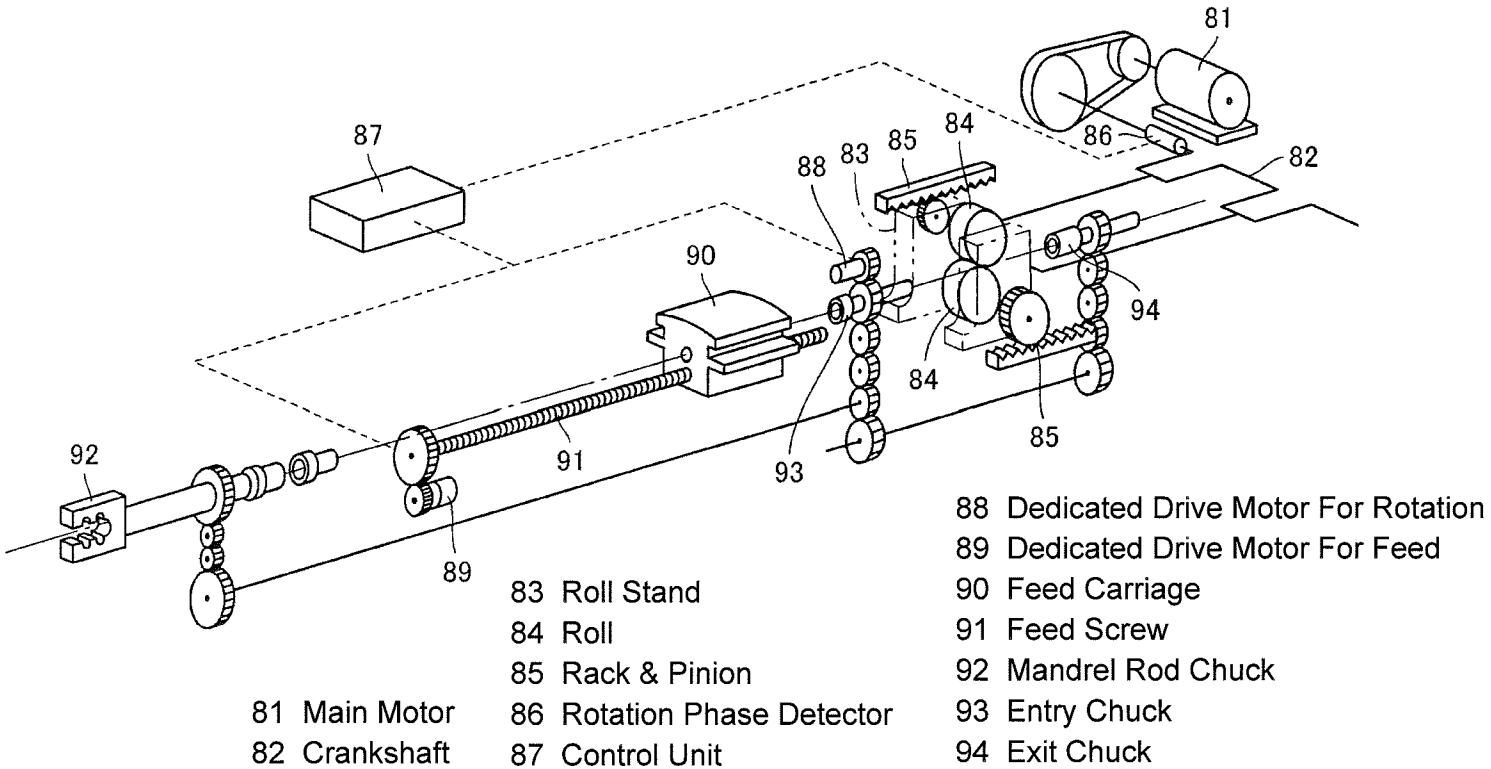
FIG. 6 is a diagram to show a schematic configuration of a cold pilger mill by a mechatronics drive system.

FIG. 6 is a diagram to show a schematic configuration of a cold pilger mill by a mechatronics drive system. The mechatronics system is a scheme of linking the feed mechanism of the hollow shell with the turning mechanism of the hollow shell and the mandrel by mechatronics, and of independently driving them by a DC servo motor or a hydraulic servo motor which is driven separately from the main motor 81.

The mechatronics system includes a rotation phase detector 86 attached to a crankshaft 82, a dedicated drive motor 89 for carriage feed, a dedicated drive motor 88 for hollow shell and mandrel turn, and a control unit 87. A signal from the rotation phase detector 86 is inputted to the control unit 87, and the control unit 87 performs a feedback control of the dedicated drive motor 89 for feed and the dedicated drive motor 88 for rotation at a timing synchronized to the motion of a roll stand 83.

That is, the periods of the reciprocating movement of the roll stand 83 and shell drive are controlled by an electric control system, and determination on whether the roll stand 83 is in a rolling section or in an idling section is performed by detecting a crank rotation angle by the rotation phase detector 86 at the end of the crankshaft. Based on that signal, a shell drive is performed at an instant of the transition from the rolling section to the idling section.

In a cold pilger mill by a mechatronics drive system, replacing a mechanical intermittent motion with an electric motion mechanism allows the simplification and the downsizing of the structure of the facility. Further, a total backlash of gear system is decreased eliminating the effects of the backlash caused by the wear of the cam and lever system, and allowing that a high dimensional accuracy of the feed and turn angle are ensured and maintained.

Figures 9A, 9B:
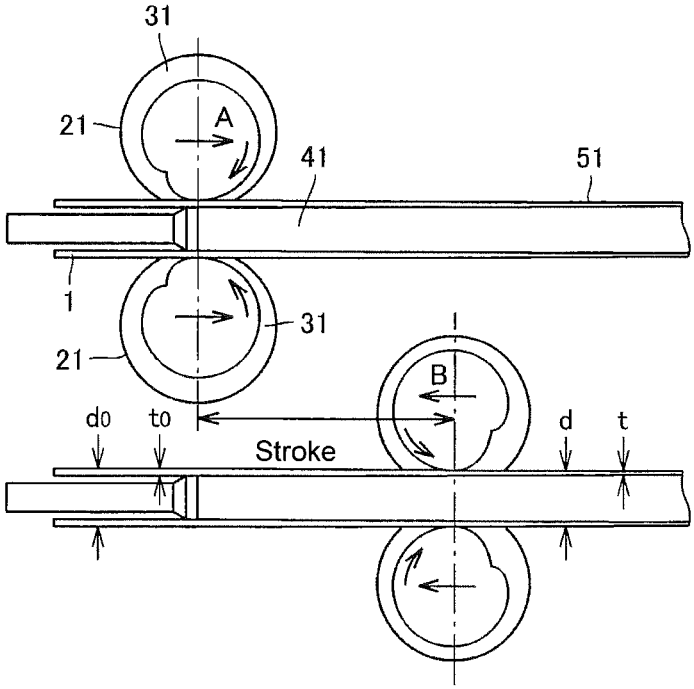
FIG. 9 is a diagram to show a third aspect of the rolling method by a cold pilger mill relating to the present invention.

FIGS. 7 to 9 are diagrams to illustrate examples of the rolling method by a cold pilger mill relating to the present invention, in which FIGS. 7A, 8A and 9A show a starting point of a forward stroke, and FIGS. 7B, 8B and 9B show a starting point of a backward stroke.

FIG. 7 is a diagram to show a first aspect of the rolling method by a cold pilger mill relating to the present invention. After predetermined amounts of turn angle and feed are given to a hollow shell (tube material) 1 immediately before the start of a forward stroke shown in FIG. 7A, a pair of upper and lower rolls 21, each of which is provided in its circumference with a tapered groove 31 whose diameter smoothly increases from an engaging entry side to a finishing exit side, is caused to move forward in the direction shown by arrow A in the diagram along the taper of a tapered mandrel 41 whose outer diameter smoothly increases from the engaging entry side to the finishing exit side. This will make the hollow shell 1 undergo elongation rolling between the surface of the tapered groove 31 of the roll 21 and the surface of the tapered mandrel 41.

Next, after a turn angle or/and a feed are given to the hollow shell 1 immediately before the start of a backward stroke as shown in FIG. 7B, while a pair of upper and lower rolls 21 are caused to reverse the direction of rotation direction to move backward in the direction shown by arrow B in the diagram, the hollow shell 1 is subjected to elongation rolling between the tapered groove 31 of the roll 21 and the tapered mandrel 41 in the same fashion.

Repeating the forward and backward rolling strokes as described above will result in that the hollow shell 1 having an outer diameter d0 and a wall thickness t0 undergoes diameter expanding rolling to yield a rolled tube product 51 having an outer diameter d and a wall thickness t.

FIG. 8 is a diagram to show a second aspect of the rolling method by a cold pilger mill relating to the present invention.

The second aspect of the present invention is a method for producing an ultrathin-wall metal tube by a cold pilger mill in which elongation is performed by decreasing the wall thickness while expanding only the inner diameter with the outer diameter being kept constant and unchanged.

FIG. 9 is a diagram to show a third aspect of the rolling method by a cold pilger mill relating to the present invention. The third aspect of the present invention is a method for producing an ultrathin-wall metal tube by a cold pilger mill in which elongation is performed by decreasing the wall thickness while reducing the outer diameter and expanding the inner diameter under the controlled condition that the amount of diameter expansion of the inner diameter is larger than the amount of diameter reduction of the outer diameter. In the second and third aspects of the present invention as well, the hollow shell 1 is subjected to elongation rolling between the tapered groove 13 of the roll 12 and the tapered mandrel 14 in the same manner as in the first aspect of FIG. 7 described above.

EXAMPLES

In order to confirm the effect of the case in which a feed and a rotation angle (turn angle) are given to the tube material not only immediately before the start of a forward stroke, but also immediately before the start of a backward stroke in the method for producing an ultrathin-wall seamless metal tube by a diameter expanding rolling method relating to the present invention, following two tests were conducted by using a cold pilger mill of mechatronics drive type and the results thereof were evaluated.

Inventive Example 1 of the Present Invention

A 18% Cr-8% Ni stainless steel tube having an outer diameter of 48.6 mm, an inner diameter of 41.6 mm, and a wall thickness of 3.5 mm produced by the Ugine extrusion process was used as the hollow shell for testing, and the hollow shell was subjected to a diameter expanding rolling by a cold pilger mill of mechatronics drive type so as to have an outer diameter of 50.8 mm, an inner diameter of 47.8 mm, and a wall thickness of 1.5 mm. In this case, the same amounts of feed and turn angle as those immediately before the start of a forward stroke were given immediately before the start of a backward stroke. Test conditions and results are summarized below.

Diameter of tapered roll groove: D=48.6 to 50.8 mm

Diameter of tapered mandrel: dm=41.5 to 47.7 mm

Feed ($f_1$) of forward stroke and feed ($f_2$) of backward stroke: $f_1=f_2=10.0$ mm Turn angle ($\theta_1$) immediately before start of forward stroke and turn angle ($\theta_2$) immediately before start of backward stroke: $\theta_1=\theta_2=60°$ Outer diameter of hollow shell: d0=48.6 mm Wall thickness of hollow shell: t0=3.5 mm Rolled tube outer diameter: d=50.8 mm Rolled tube wall thickness: t=1.5 mm Ratio of Diameter expansion: d/d0=1.045 (diameter expansion rate: 5%)

Elongation ratio: t0(d0−t0)/{t(d−t)}=2.13

(Wall thickness/Outer diameter) Ratio: t/d=2.95%

Inventive Example 2 of the Present Invention

A 25% Cr-35% Ni-3% Mo high alloy steel tube having an outer diameter of 47.2 mm, an inner diameter of 40.2 mm, and a wall thickness of 3.5 mm produced by the Mannesmann-mandrel mill process was used as the hollow shell for testing, and the hollow shell was subjected to a diameter expanding rolling by a cold pilger mill of mechatronics drive type so as to have an outer diameter of 50.8 mm, an inner diameter of 48.2 mm, and a wall thickness of 1.3 mm. In this case as well, the same amount of feed and turn angle as those immediately before the start of a forward stroke were given immediately before the start of a backward stroke. Test conditions and results are summarized below.

Diameter of tapered roll groove: D=47.2 to 50.8 mm

Diameter of tapered mandrel: dm=40.0 to 48.0 mm

Feed ($f_1$) of forward stroke and feed ($f_2$) of backward stroke: $f_1=f_2=8.0$ mm Turn angle ($\theta_1$) immediately before start of forward stroke and turn angle ($\theta_2$) immediately before start of backward stroke: $\theta_1=\theta_2=60°$ Outer diameter of hollow shell: d0=47.2 mm Wall thickness of hollow shell: t0=3.5 mm Rolled tube outer diameter: d=50.8 mm Rolled tube wall thickness: t=1.3 mm Ratio of Diameter expansion: d/d0=1.076 (diameter expansion rate: 8%)

Elongation ratio: t0(d0−t0)/{t(d−t)}=2.38

(Wall thickness/Outer diameter) Ratio: t/d=2.56%

The steel tubes obtained from the above described testing of two Examples had beautiful inner and outer surface textures, and their qualities deserve special mention. It is noted that when elongation rolling was performed by a conventional diameter reducing rolling method in which neither feed nor turn angle was given immediately before the start of a backward stroke, the minimum wall thicknesses which could be produced for a stainless steel tube and a high alloy steel tube were about 2.0 to 2.5 mm when the outer diameter was 50.8 mm. Therefore, the effect of the method for producing an ultrathin-wall seamless metal tube by a diameter expanding rolling method relating to the present invention is extremely marked.

INDUSTRIAL APPLICABILITY

The present inventors previously confirmed that in a conventional cold pilger mill of mechanical drive type in which a feed and a turn were given to a tube material only immediately before the start of a forward stroke, and rolling was performed in both the forward and backward strokes, by adopting a diameter expanding rolling method in place of the diameter reducing rolling method, a dramatically high reduction-rate was obtained and thereby an ultrathin-wall seamless metal tube was able to be produced; which has been disclosed in Patent Literature 1.

The present invention has solved the problems of the increase of the excessive rolling load and the imbalance in the rolling load when amounts of feed and turn angle equivalent or nearly equivalent to those in the forward stroke are given immediately before the start of a backward stroke as well in a diameter expanding rolling method by a cold pilger mill of mechatronics drive type, and has realized a further increase in the reduction-rate of rolling and a further reduction of wall thickness, as well as has significantly improved the dimensional accuracy and the production efficiency of the rolled tube product.

The present invention is a diameter expanding rolling method in which not so much larger ratio of diameter expansion is applied, which will provide significant merits in the production technology. For example, applying not so much larger ratio of diameter expansion will allow a conventional system to be utilized as-is without need of particularly modifying the shell drive system of a cold pilger mill.

Though the present invention intends to claim proprietary rights in the cold rolling by a cold pilger mill of mechatronics drive type in which the reciprocating movement of the roll stand and the shell drive of a tube material are controlled by an electric control system, it should be noted that the present invention can be utilized as-is in a cold rolling by a cold pilger mill of mechanical drive type in which the reciprocating movement of the roll stand and the shell drive are controlled by a mechanical control system. However, this is based on the premise that a further technical innovation is achieved in the mechanical structure of the cold pilger mill of mechanical drive type.

REFERENCE SIGNS LIST

1: Tube material (hollow shell), 2: Grooved roll, 3: Tapered groove, 4: Tapered mandrel, 5: Rolled tube, 21: Grooved roll, 31: Tapered groove, 41: Tapered mandrel, 51: Rolled tube.

What is claimed is:

1. A method for producing an ultrathin-wall seamless metal tube by a cold rolling method in which employed is a cold pilger mill of mechatronics drive type that includes: an electric control system to control a reciprocating movement of a roll stand and a shell drive of a tube material; and a mechanism to give a feed and a turn angle to the tube material immediately before the start of a forward stroke and immediately before the start of a backward stroke, the method comprising:

utilizing a roll having a groove whose diameter gradually increases, remains constant, or gradually decreases from an engaging entry side to a finishing exit side of a pair of rolls, and a tapered mandrel whose diameter similarly gradually increases from the engaging entry side to the finishing exit side; and giving a turn angle and a feed to the tube material immediately before the start of a forward stroke, and also giving a shell drive to the tube material immediately before the start of a backward stroke so as to bring a load balance between forward and backward strokes while suppressing the upper limit of rolling load during the course from the engaging entry side to the finishing exit side, thereby elongating the tube material by reducing a wall thickness while expanding a mid-wall diameter which is an average diameter of an outer diameter and an inner diameter of the tube material.

2. The method for producing an ultrathin-wall seamless metal tube by a cold rolling method according to claim 1, wherein a turn angle of 60° or less is also given to the tube material immediately before the start of a backward stroke.

3. The method for producing an ultrathin-wall seamless metal tube by a cold rolling method according to claim 1, wherein a feed of 10.0mm or less is also given to the tube material at immediately before the start of a backward stroke.

4. The method for producing an ultrathin-wall seamless metal tube by a cold rolling method according to claim 1, wherein a turn angle of 60° or less and a feed of 10.0mm or less are also given to the tube material immediately before the start of a backward stroke.

5. The method for producing an ultrathin-wall seamless metal tube by a cold rolling method according to claim 1, wherein The ratio of expansion of the mid-wall diameter, which is in an average diameter of an outer diameter and an inner diameter of the tube material is 10% or less, and the ratio of wall thickness to outer diameter is 4% or less.

* * * * *

UNITED STATES PATENT AND TRADEMARK OFFICE

CERTIFICATE OF CORRECTION

PATENT NO. : 8,528,378 B2
APPLICATION NO. : 13/246086
DATED : September 10, 2013
INVENTOR(S) : Hayashi It is certified that error appears in the above-identified patent and that said Letters Patent is hereby corrected as shown below:

In the Claims

Column 11, line 35, Claim 1:
"rolls, and a tapered mandrel whose diameter similarly"
should read:
"rolls, and a tapered mandrel whose diameter"

Signed and Sealed this
Eleventh Day of March, 2014

Michelle K. Lee

Michelle K. Lee
*Deputy Director of the United States Patent and Trademark Office*